United States Patent [19]

Nida

[11] Patent Number: 4,644,697

[45] Date of Patent: Feb. 24, 1987

[54] SECURITY SCREEN ASSEMBLY

[76] Inventor: Edmund A. Nida, 25779 Ridgewood Dr., Farmington Hills, Mich. 48018

[21] Appl. No.: 652,887

[22] Filed: Sep. 21, 1984

[51] Int. Cl.[4] ..... E05D 7/00; A47H 13/00

[52] U.S. Cl. ..... 49/401; 49/397; 160/389; 160/398

[58] Field of Search ..... 49/401, 397; 160/398, 160/389; 52/656

[56] References Cited

U.S. PATENT DOCUMENTS

| | | | |
|---|---|---|---|
| 2,096,421 | 10/1937 | Bayley | 49/397 X |
| 2,314,481 | 3/1943 | Crooks | 160/398 X |
| 2,336,189 | 12/1943 | Price | 160/398 X |
| 2,889,900 | 6/1959 | Singleton | 49/397 X |
| 3,103,714 | 9/1963 | Wilks | 49/401 |
| 3,197,932 | 8/1965 | Nida . | |
| 3,380,218 | 4/1968 | Fabich | 52/656 |
| 3,517,660 | 6/1970 | Springer et al. | 52/656 X |

FOREIGN PATENT DOCUMENTS

| | | | |
|---|---|---|---|
| 286437 | 6/1967 | Australia | 49/397 |
| 888309 | 7/1953 | Fed. Rep. of Germany | 49/401 |
| 17548 | of 1888 | United Kingdom | 160/398 |

*Primary Examiner*—Kenneth J. Dorner
*Assistant Examiner*—Mark W. Binder
*Attorney, Agent, or Firm*—Barnes, Kisselle, Raisch, Choate, Whittemore & Hulbert

[57] ABSTRACT

A security screen assembly comprising a sub-frame mounted within an opening in a building and a hinged main frame which has a screened opening. Keys are provided at each corner of each frame to maintain the frame members in a predetermined angular relationship. The hinge is designed to permit assembly and disassembly of the hinged parts by a movement through an open side of one of the hinge parts. The screen is marginally held within the opening in the pivoted frame by screws extending through the margin of the screen which self-tap into a slot in the frame members, and ribs and slots on the main frame and sub-frame are provided to prevent warping of the parts in the closed position.

5 Claims, 11 Drawing Figures

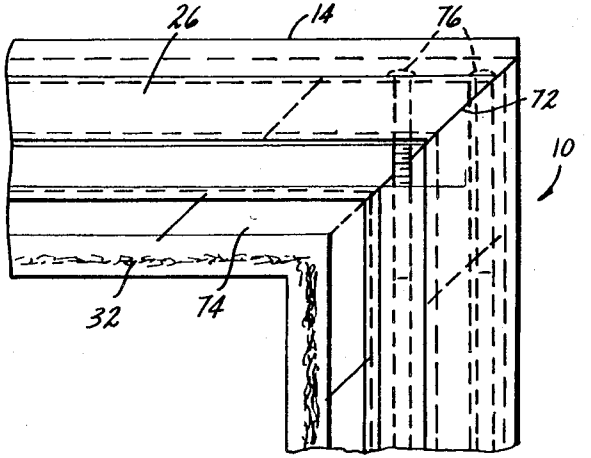
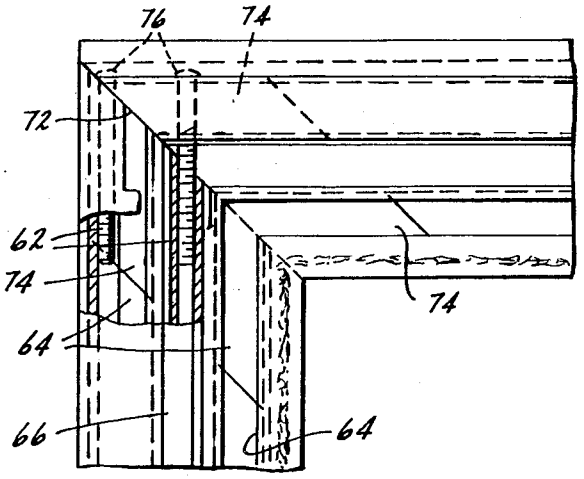
FIG. 6
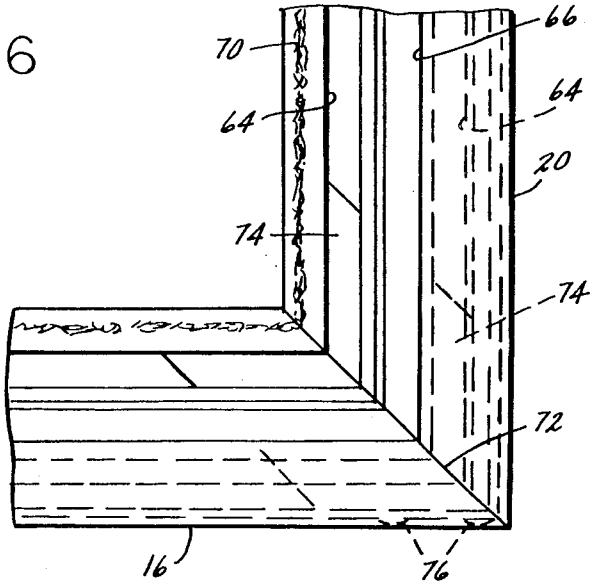
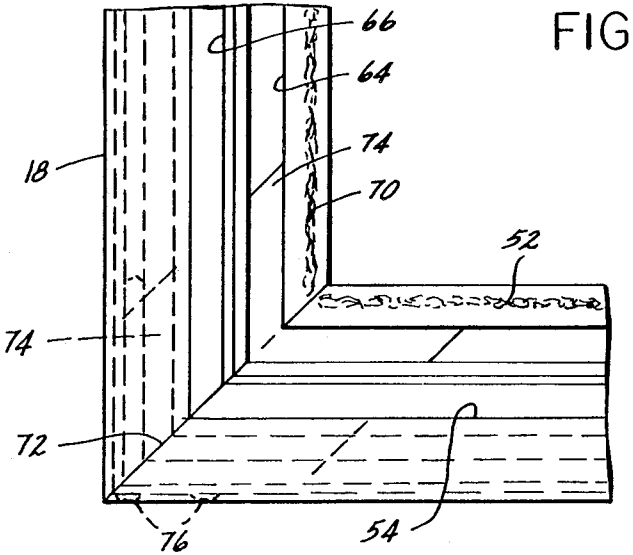
FIG. 7
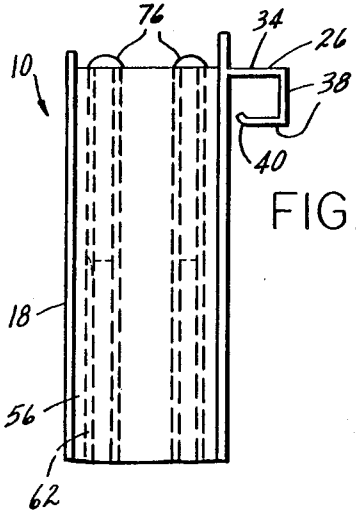
FIG. 9
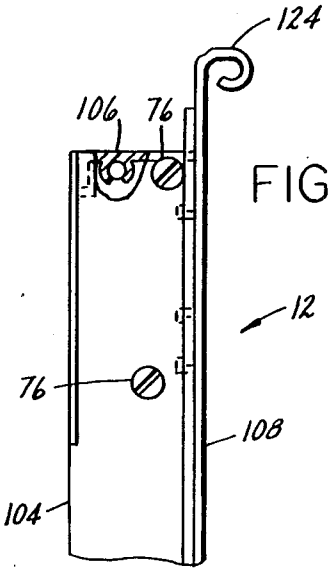

SECURITY SCREEN ASSEMBLY

This invention relates generally to a security screen assembly.

SUMMARY OF THE INVENTION

The security screen assembly of this invention is designed to prevent unauthorized entry into a building and comprises a sub-frame mounted within an opening in the building and a hinged main frame which has a screened opening. In accordance with one feature of the invention, the sub-frame and main frame are each composed of four frame members with means provided for holding the frame members in assembled relation comprising aligning keys which fit in connecting channels or grooves of the two frame members at each corner, and screws at each corner which extend through one frame member and thread into bosses in the other.

Another feature of the invention is in the provision of an improved hinge connection permitting pivotal movement of the main frame relative to the sub-frame between open and closed positions, with aligning means to prevent warping of the main frame out of register with the sub-frame in the closed position.

In accordance with another feature of the invention, the hinged connection comprises an elongated tubular member on the sub-frame having a longitudinally extending slot, and an enlargement on the main frame pivotally received in the tubular member and capable of being introduced into and removed from the tubular member through the slot, with means normally operative to prevent such removal.

A still further feature of the invention resides in the provision of improved means for marginally securing the screen within the opening in the main frame.

These and other objects and features of the invention will become more apparent as the following description proceeds especially when considered with the accompanying drawings.

BRIEF DESCRIPTION OF THE DRAWINGS

FIG. 6 is an outside elevation of the sub-frame with parts broken away and in section.

FIG. 7 is a side edge view of the sub-frame as viewed from the upper left in FIG. 6.

FIG. 9 is a fragmentary side edge view of the main frame as viewed from the upper right in FIG. 8.

DETAILED DESCRIPTION

Figure 2:
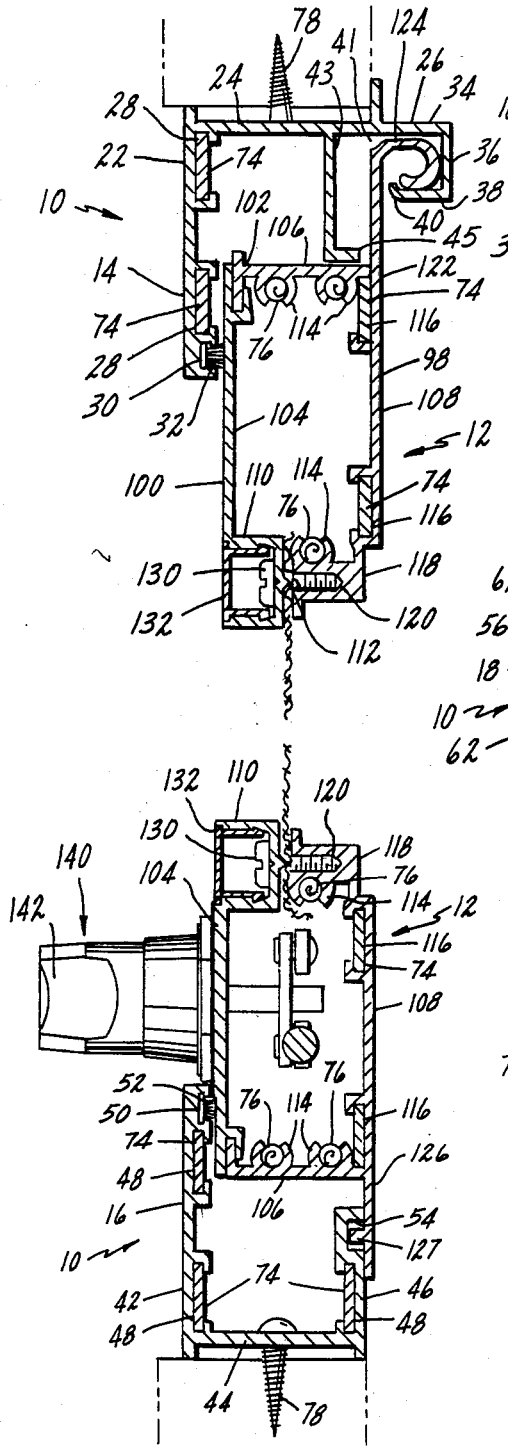
FIG. 2 is a sectional view taken on the line 2—2 in FIG. 1.

Referring now more particularly to the drawings, the security screen assembly comprises a sub-frame 10 to which a main frame 12 is pivoted.

The sub-frame is made of vertically spaced horizontal top and bottom frame members 14 and 16 and laterally spaced vertically extending side frame members 18 and 20. These frame members are joined together end-to-end to define a rectangular opening.

The top frame member is an extrusion having the cross section shown from end to end. It has a vertical rear wall 22, a horizontal top wall 24 extending forwardly from the top of the rear wall, and a tubular hinge part 26. On the front side of the rear wall are two parallel vertically spaced undercut channels or grooves 28 which are open at the front along their full length and which extend the full length of the frame member. Also on the front side of the rear wall is a slot 30 beneath the grooves which is open along its full length and which extends the full length of the frame member. A sealing strip 32 of felt or the like is disposed in the slot.

The tubular hinge part 26 extends along the front edge of the top wall, having a top horizontal wall 34, a front vertical wall 36 extending downwardly from the forward edge of the top wall and a horizontal bottom wall 38 extending rearwardly from the lower edge of the front wall, which bottom wall has an upturned terminal lip 40. This tubular hinge part is open at both ends of the frame member. It is also open throughout its full length between the lip 40 and the top wall 34 to define a slot 41. The ends of the rear wall of the top frame member and of the hinge part are cut on a 45° angle to provide mitered corners at the top of the sub-frame. A wall 43 parallel to rear wall 22 extends downwardly from top wall 24. Wall 43 is spaced from the hinge part 26 and extends for the full length of the top frame member. Wall 43 has a right angle flange 45 at the end extending away from the rear wall.

The bottom frame member is an extrusion having the cross section shown from end to end. It has a vertical rear wall 42, a horizontal bottom wall 44 extending forwardly from the lower edge of the rear wall, and a vertical front wall 46 extending upwardly from the forward edge of the bottom wall. On the front side of the rear wall are two parallel vertically spaced undercut channels or grooves 48 which are open at the front along their full length and which extend the full length of the frame member. Also on the front side of the rear wall is a slot 50 above the grooves which is open along its full length and which extends the full length of the rear wall. A sealing strip 52 of felt or the like is disposed in this slot.

On the rear side of the front wall is an undercut channel or groove 48 which is open at the rear along its full length and which extends the full length of the frame member. On the front side of the front wall is a slot 54 near the upper edge thereof which is open along its full length and which extends the full length of the front wall.

The ends of the front and rear walls of the bottom frame member are cut at a 45° angle to provide mitered corners at the bottom of the sub-frame.

Figure 3:
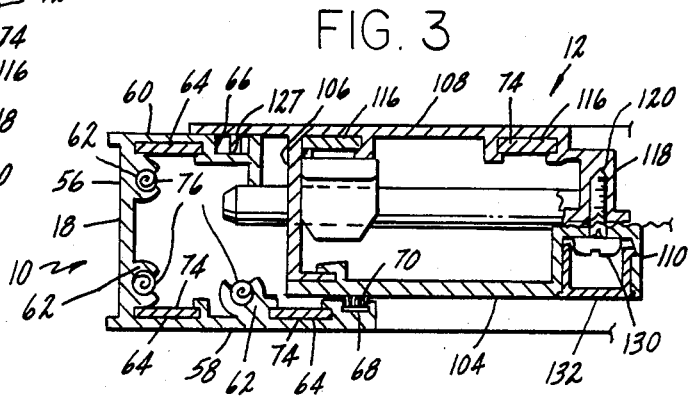
FIG. 3 is a sectional view taken on the line 3—3 in FIG. 1.
Figure 4:
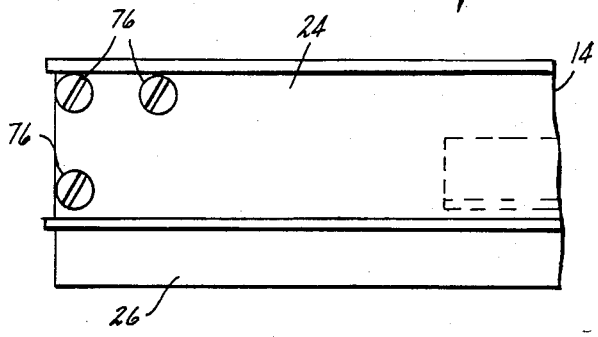
FIG. 4 is a fragmentary top edge view of the sub-frame as view from the upper left in FIG. 1.
Figure 5:
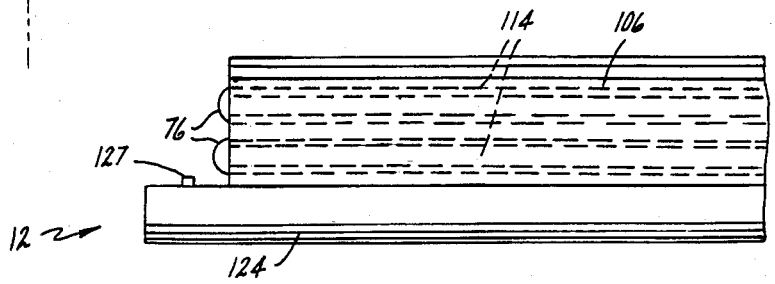
FIG. 5 is a fragmentary top edge view of the main frame as viewed from the upper left in FIG. 1.

The side frame members are extrusions and mirror images of one another. The side frame member 18 has the cross section shown in FIG. 3. The side frame member 18 has three vertical walls, a laterally outer wall 56, a rear wall 58 extending laterally inwardly from the outer wall and a front wall 60 extending laterally inwardly from the outer wall in spaced parallel relation to the rear wall. The laterally outer wall has two spaced parallel bosses 62 extending for the full length thereof along the laterally inner surface, each having a cylindrical recess which is open along the inner side from end-to-end.

The rear side of the front wall has an undercut channel or groove 64 which is open at the front along its full length and which extends the full length of the frame member. The front wall has a slot 66 on the front side which extends the full length thereof and is open along its full length.

The rear wall on its front side has two parallel laterally spaced undercut channels or grooves 64 which are open at the front along their full length and which extend the full length of the frame member. Also on the front side of the rear wall between the grooves there is a boss 62, similar to those previously described, which extends the full length of the frame member and is open along the front side throughout its full length. Also on the front side of the rear wall is a slot 68 along the inner edge of the frame member which is open along its full length and which extends the full length of the frame member. A sealing strip 70 of felt or the like is disposed in this slot.

The ends of the front and rear walls of the side frame members are cut at a 45° angle to provide mitered corners at the four corners of the sub-frame.

The sub-frame is constructed by arranging the top, bottom and side frame members in a rectangle with their mitered ends in contact to form the 45° mitered corners 72 as shown. In this arrangement of the frame members, the two grooves of the top frame member connect with two of the grooves in the side frame members at each end thereof. Also, the three grooves of the bottom frame member connect at their ends with the three grooves of the two side frame members. Rigid right angle keys 74 are provided in the grooves at each corner to accurately locate the frame members in coplanar relation. Each key has two legs at right angles to one another, the keys being provided at the corners and each having one leg in a groove of one frame member and the other in a groove of the meeting frame member. The four sealing strips 32, 52 and 70 connect end to end. The slots 54, 66 and 66 also connect end-to-end. Screw fasteners 76 extend through the top and bottom walls of the top and bottom frame members and self-tap into the bosses in the side frame members to form a rigid sub-frame construction. The sub-frame is installed in a building opening by suitable fasteners 78.

The main frame 12 is made of vertically spaced top and bottom frame members 90 and 92 and laterally spaced side frame members 94 and 96 which are joined together end-to-end to define a rectangular opening. The main frame, as stated previously, is hinged to the sub-frame, the hinge connection being along the upper edges of the two frames and the main frame swinging to a substantially flush condition with respect to the sub-frame when closed. In the closed position, the side frame members of the sub-frame extend vertically. At all times the top and bottom frame members are horizontal.

The top frame member has the cross section shown from end to end. It is formed of two extrusions 98 and 100 which are interlocked with one another at the point indicated at 102. The top frame member has a vertical rear wall 104, a horizontal top wall 106 extending forwardly from the top of the rear wall, and a vertical front wall 108 extending downwardly from the forward edge of the top wall in spaced parallel relation to the rear wall. On the lower edge portion of the rear wall 104, there is a horizontal channel 110 opening rearwardly and extending for the full length of the rear wall. A V-shaped ridge or rib 112 extends lengthwise of the base of the channel on the front side thereof.

The top wall 106 has two laterally spaced bosses 114 extending for the full length thereof along the bottom surface, of the same configuration as the bosses previously described.

On the rear side of the front wall 108 are two parallel vertically spaced undercut channels or grooves 116 which are open at the rear along their full length and which extend the full length of the frame member. There is an integral bar 118 along the lower edge of the front wall 108 which is parallel with and opposed to the channel 110 along the lower edge of the rear wall. The top surface of this bar has a boss 114 extending from the full length thereof, of the same configuration as those already described. There is a slot 120 in the bar 118 opening toward the channel 110 which extends for the full length of the enlargement. The channel 110 and bar 118 together define the upper edge of the opening in the main frame.

Extending upwardly from the front wall 108 is a wall extension 122 terminating in an enlargement in the form of a rolled hinged part 124 which fits within the tubular hinge part 26 on the sub-frame. The enlargement is rolled to substantially cylindrical form although open along one side as shown in FIG. 2.

Figure 1:
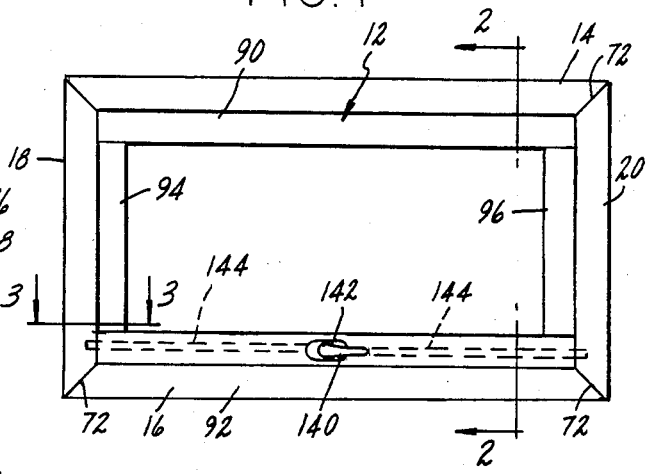
FIG. 1 is an inside elevational view of a security screen assembly constructed in accordance with my invention.
Figure 8:
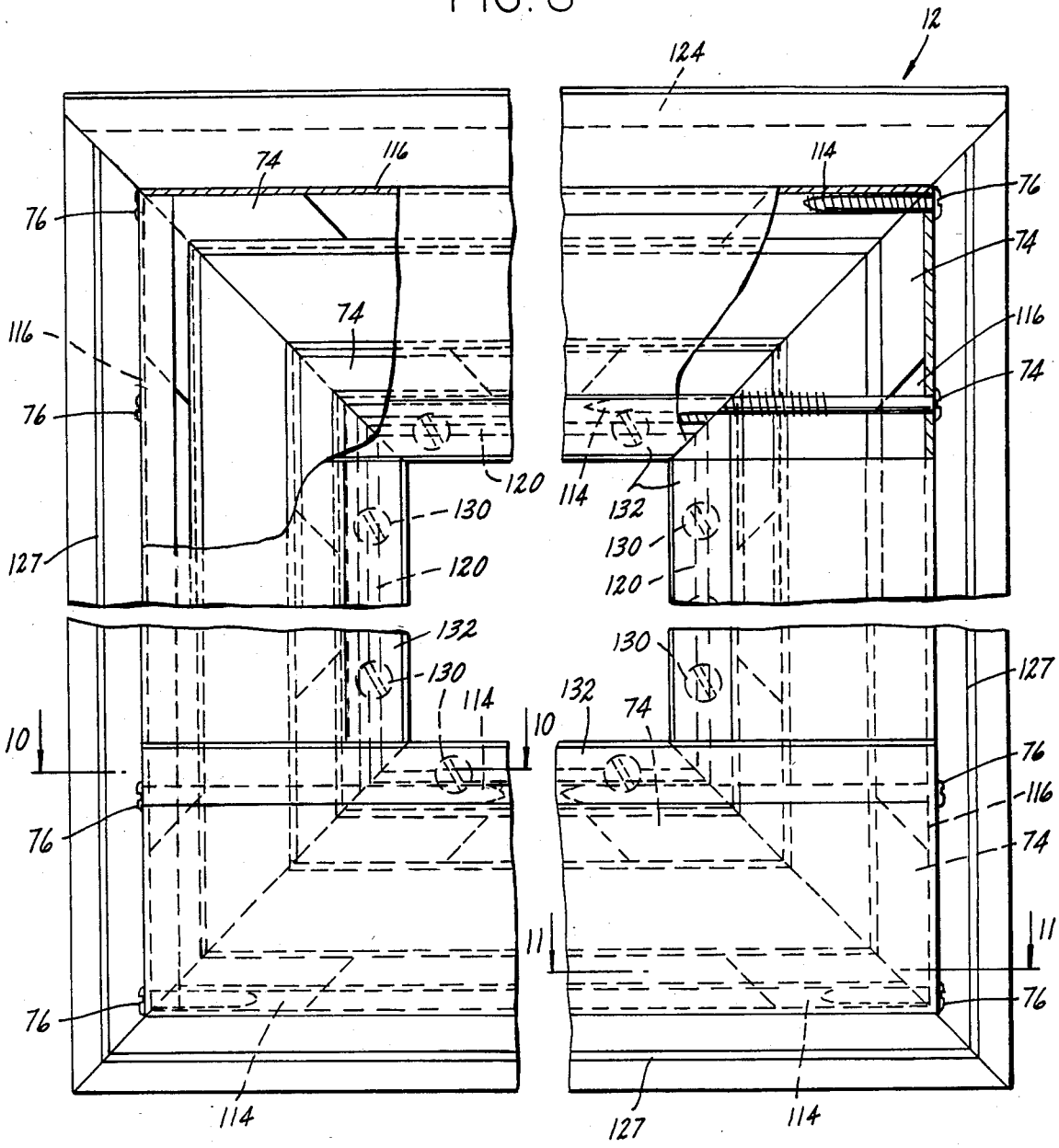
FIG. 8 is an inside elevational view of the main frame with parts broken away and in section.
Figure 10:
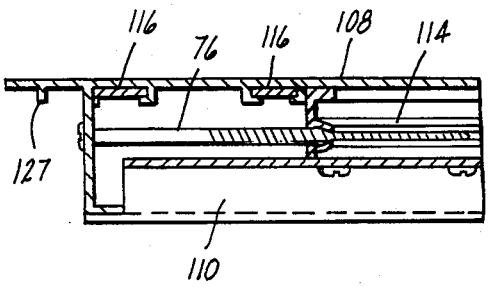
FIG. 10 is a fragmentary sectional view taken on the line 10—10 in FIG. 8.
Figure 11:
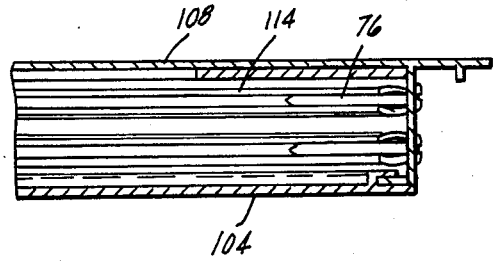
FIG. 11 is a fragmentary sectional view taken on the line 11—11 in FIG. 8.

The front wall 108 of the top frame member 90 is mitered at the ends at a 45° angle, but the ends of the rear wall 104 are not mitered as seen in FIGS. 1 and 8 but extend for substantially the full length of the frame member.

The bottom frame member 92 is an extrusion of substantially the same configuration as the top frame member 90 although upside down in relation to the top side frame member so that its channel 110 and bar 118 are at the top in order to define the lower edge of the opening in the main frame. The bottom frame member differs from the top frame member in that instead of having a wall extension terminating in a hinge part, it has a wall extension 126 provided with a rearwardly extending rib 127 which extends for the full length of the frame member. It should not be necessary to further describe the bottom frame member 92 in which parts corresponding to those of the top frame member 90 are identified by similar characters of reference.

The side frame members 94 and 96 are extrusions of substantially the same configuration as the bottom frame member except that they have no bosses. The channels 110 and bars 118 of the side frame members 94 and 96 define the side edges of the opening in the main frame. The same reference characters are used for the parts of the side frame members as for corresponding parts of the bottom frame member.

The main frame is constructed by arranging the top, bottom and side frame members 90–96 in a rectangle with the mitered ends of the front walls in contact and with the unmitered ends of the rear walls of the top and bottom frame members extending across the unmitered ends of the rear walls of the side frame members. In this arrangement, the grooves of the members line up at each corner of the frame. Right angle keys 74, similar to those employed in the sub-frame, are provided in the grooves in each corner to accurately locate the frame members in coplanar relation. Each key has two legs at right angles to one another, the keys being provided at the corners and each having one leg in a groove of one frame member and the other leg in a groove of the meeting frame member. Screw fasteners 76 extend through the laterally outer walls of the side frame members and self-tap into the bosses in the top and bottom frame members to form a rigid main frame construction. When assembled, the three ribs 127 of the main frame connect end-to-end.

The opening in the main frame is closed by a rectangular screen, the four marginal edges of which extend between the channel 110 and bar 118 of each main frame member. With the screen drawn taut, threaded fasteners 130 are inserted, extending through the base of the channels and into the slots 120 formed in each bar, self-tapping into these slots. When the screws are tightened, the rib or ridge 112 on the bottom of each channel is pressed down against the screen forcing it into the slot 120 to make a secure attachment. A removable cover strip 132 of channel form snaps into each channel 110 to cover and conceal the screws.

The main frame is hinged to the sub-frame by inserting the rolled hinge part 124 of the main frame into the tubular hinge part 26 of the sub-frame. These hinge parts are assembled by swinging the main frame away from the sub-frame approximately 90°, placing the rolled hinge part 124 under the tubular hinge part 26, and then swinging the main frame back toward the sub-frame while fitting the open side of the rolled hinge part over the lip 40 and into the tubular hinge part 26. The wall 43 is spaced far enough from the tubular hinge part 26 to permit assembly of the hinge parts 26 and 124 of the main frame and sub-frame in this manner. During normal opening and closing movement of the main frame through less than 90°, the wall 43 is close enough to the tubular hinge part 26 to prevent accidental separation of the hinge parts. However, to separate the hinge parts and disassemble the main frame from the sub-frame, the main frame is swung out to an approximate 90° angle and pushed rearwardly until the rolled hinge part 124 abuts the wall 43, whereupon the rolled hinge part 124 will drop out of the tubular hinge part 26. The purpose of flange 45 at the bottom of wall 43 is to catch the upper edge portion of the main frame as it drops out of the tubular hinge part 24 and thereby prevent damage to the main frame.

Any suitable latching mechanism may be provided to secure the main frame in close position with respect to the sub-frame. In the present instance, latching mechanism 140 is employed mounted on the bottom frame member of the main frame and having a handle 142 on the rear side thereof (inner side of building) which when rotated extends locking rods 144 through holes in the laterally outer walls of the side frame members of the main frame to engage behind suitable abutments on the side frame members of the sub-frame to lock the main frame in closed position. In the closed position of the main frame, the main frame is substantially flush within the plane of the sub-frame and rear walls of the four frame members of the main frame press along a continuous and uninterrupted rectangular line against the four sealing strips 32, 52, 70 and 70. Also, the three ribs 127 on the bottom and side frame members of the main frame fit into the continuous three sided slot provided by slots 54, 66 and 66 in the bottom and side frame members of the sub-frame to prevent warping of the main frame out of register with the sub-frame in the closed position.

I claim:

1. A security screen assembly comprising a rectangular sub-frame composed of top, bottom and side sub-frame members abutting end-to-end at the four corners of the frame to define a rectangular opening, said top sub-frame member having a back wall, said bottom and said sub-frame members each having front and back walls, a channel in the back wall of each sub-frame member at each corner with the channels of abutting sub-frame members connecting with one another, additional channels in the front walls of the side and bottom sub-frame members at each bottom corner with said additional channels of abutting side and bottom sub-frame members connecting with one another, means at each corner of said sub-frame for holding the sub-frame members in predetermined angular relationship comprising a rigid L-shaped key engaged in each of the connecting channels, a rectangular main frame composed of top, bottom and side main frame members abutting end-to-end at the four corners threreof and defining a rectangular, screened opening, each main frame member having front and back walls, a channel in the front wall of each main frame member at each corner of said main frame with the channels of abutting main frame members connecting with one another, means at each corner of said main frame for holding said main frame members in predetermined angular relationship comprising a rigid key engaged in the connecting channels thereof, fasteners at each corner of said sub-frame and main frame for securing said abutting frame members together, a hinged connection between said frames permitting pivotal movement of said main frame between an open position and a closed position closing the opening in said sub-frame in which the rear walls of said main frame members overlap and are substantially flush with the rear walls of said sub-frame members, means for releasably latching said main frame closed, and means for aligning said main frame with respect to said sub-frame in the closed position thereof comprising elongated slots along the front wall of the bottom and side sub-frame members and elongated ribs along the front wall of the bottom and side main frame members, said slots receiving said ribs in the closed position of the main frame, said keys in the channels of the front walls of said bottom and said sub-frame and main frame members being located adjacent said slots and ribs to assist said slots and ribs in aligning said main frame with respect to said sub-frame when closed.

2. A security screen assembly as defined in claim 1, including a sealing strip on the back wall of said sub-frame members extending continuously around the opening in said sub-frame and contacting the back walls of said main frame members in the closed position of said main frame.

3. A security screen assembly as defined in claim 2, wherein said hinged connection comprises an elongated tubular member extending forwardly from the front wall of the top sub-frame member and having a longitudinal slot, and an elongated enlargement on the front wall of the top main frame member pivotally received in said tubular member.

4. A security screen assembly as defined in claim 3, including wall means for preventing withdrawal of said enlargement from said tubular member through said slot during swinging of said main frame with respect to said sub-frame through a limited angle but permitting said enlargement to be introduced into and withdrawn from said slot when said main frame is swung out from said sub-frame beyond said limited angle, said wall means having a flange beneath said tubular member to catch the enlargement of said main frame when said enlargement is withdrawn from said tubular member.

5. A security screen assembly as defined in claim 2, including a screen covering the opening in said main frame, means for marginally securing said screen in said main frame opening comprising a first securing member on the front wall of each main frame member underlying a marginal edge of said screen, an elongated slot in each first securing member, a second securing member on the back wall of each main frame member overlying said marginal edge of said screen, fasteners extending through said second securing members and said marginal edge of said screen and threading into said slots, said second securing members having elongated ribs in opposed relation to said slots which are pressed toward said slots by said fasteners to force portions of said marginal edge of said screen into said slots.

* * * * *